United States Patent [19]

Fukushima et al.

[11] 4,203,196

[45] May 20, 1980

[54] WIRE INSERTION TOOL

[75] Inventors: Hiroyuki Fukushima; Minoru Yoshida, both of Tokyo; Hiromasa Inoue, Musashino, all of Japan

[73] Assignee: Bunker Ramo Corporation, Oak Brook, Ill.

[21] Appl. No.: 909,581

[22] Filed: May 25, 1978

Related U.S. Application Data

[63] Continuation of Ser. No. 790,629, Apr. 25, 1977, abandoned.

[30] Foreign Application Priority Data

Jun. 4, 1976 [JP] Japan ..... 51-052425

[51] Int. Cl.[2] ..... H01R 43/04

[52] U.S. Cl. ..... 29/566.3; 29/749; 29/753; 29/760

[58] Field of Search ..... 29/749, 741, 750, 755, 29/628, 33 M, 753, 760, 566.3

[56] References Cited

U.S. PATENT DOCUMENTS

| | | | |
|---|---|---|---|
| 3,800,390 | 4/1974 | Johnston | 29/749 |
| 3,803,695 | 4/1974 | Tucci | 29/749 |
| 3,866,293 | 2/1975 | Nijman | 29/749 |
| 3,885,287 | 5/1975 | Long et al. | 29/749 |
| 3,935,628 | 2/1976 | Tucci | 29/749 |
| 3,938,246 | 2/1976 | Over et al. | 29/742 |
| 3,952,392 | 4/1976 | Nijman et al. | 29/566.3 |
| 3,965,558 | 6/1976 | McKee | 29/749 |
| 3,968,555 | 7/1976 | Holt | 29/749 |
| 3,972,101 | 8/1976 | Casey et al. | 29/749 |
| 3,999,270 | 12/1976 | Witte | 29/749 |
| 4,038,745 | 8/1977 | Nijman | 29/749 |
| 4,048,711 | 9/1977 | Haller | 29/749 |

*Primary Examiner*—Daniel C. Crane
*Attorney, Agent, or Firm*—F. M. Arbuckle; N. A. Camasto

[57] ABSTRACT

A tool for simultaneously inserting each of a plurality of wires in respective non-deforming insulation piercing terminals disposed in a terminal retaining body. The terminal retaining body is supported in the tool so that each terminal is aligned with a guide slot through which the wires are forced by the action of insertion tabs. The ends of the wires are retained in coil springs which are coupled to releasing handles so that the springs may be extended to facilitate removal of the wires. As the insertion tabs are forced through the guide slots, a cutting member disposed in each of the slots cooperates with an edge of the insertion tabs to cut the wire at a predetermined point. The tool is adjustable to accept terminal retaining bodies of various shapes and sizes.

12 Claims, 13 Drawing Figures

WIRE INSERTION TOOL

This is a continuation application of application Ser. No. 790,629, filed Apr. 25, 1977, now abandoned.

BACKGROUND OF THE INVENTION

1. Field of the Invention

This invention relates to the field of tools for inserting wires in non-deforming insulation piercing terminals, and more particularly to the field of tools for simultaneously installing a plurality of wires in a corresponding plurality of terminals disposed in a terminal retaining body.

2. Description of the Prior Art

Non-deforming insulation piercing terminals allow for a much more rapid assembly of multiconductor connectors and terminal blocks than was allowed by conventional terminals which required the wires to be stripped of their insulation before insertion or required individual crimping of each terminal to secure it to a wire. In order to take full advantage of this, it is desirable to insert all of the wires to be connected to a terminal retaining body simultaneously.

Devices of the prior art for simultaneously inserting a plurality of wires in this type of terminal block have been prone to faulty wiring due to incomplete insertion of the wires into the terminals and have required so much labor for the insertion and removal of the wires from the tool that little time was saved over individual insertion of the wires in one terminal at a time. U.S. Pat. No. 4,038,745, issued Aug. 2, 1977 to John P. Nijman, and its pending divisional patent application Ser. No. 768,578, filed Feb. 14, 1977, both of which are assigned to the assignee of the present invention, discloses a ratchet and pawl insertion control mechanism for alleviating the aforementioned problem. However, this device, like other prior devices, does not include a mechanism in cooperative association with such insertion control means to readily hold the wires in position for insertion as well as to permit easy and simultaneous removal of the wired terminal retaining body and the severed wires from the termination tool after complete insertion of the wires.

SUMMARY OF THE INVENTION

It is an object of the present invention to provide a tool for simultaneously inserting a plurality of wires in the terminals of the terminal retaining body which is simpler and faster to use than the devices of the prior art.

It is a further object of the present invention to provide a wire insertion tool which automatically cuts the individual wires at a predetermined point prior to their insertion in the terminals.

It is still a further object of the present invention to provide a tool which simultaneously releases the wired terminal retaining body and the severed ends of the wires after completion of the insertion operation.

It is an additional object of the present invention to provide a wire insertion tool which includes a ratchet mechanism to assure that the wires completely inserted in the terminals before the terminal retaining body is removed from the tool.

The present invention fulfills the above objects by providing a wire insertion tool which supports the terminal retaining body such that each terminal is aligned with a slot between guide members. A plurality of insertion tabs are provided for forcing the wires through the slots between the guide members and into the terminals. The ends of the wires are held by coil springs disposed adjacent the guide plates. Cutting members are disposed between each of the guide plates which cooperate with the insertion tabs to cut the wires at a predetermined position prior to their insertion into the terminals.

Releasing handles are provided which cooperate to move the guide plates away from the terminal retaining body and simultaneously extend the coil springs to facilitate removal of the terminal retaining body and the severed ends of the wires.

The wire insertion tabs are connected to insertion handles such that when the handles are brought together the insertion tabs enter the slots between the guiding members. A ratchet mechanism may be coupled to the insertion handles to assure that the handles are not separated until they have been brought within a predetermined distance of each other which assures that the wires are fully inserted in the terminals.

BRIEF DESCRIPTION OF THE DRAWINGS

The invention will now be described in detail with reference to the accompanying drawings representing preferred embodiments of the wire insertion tool according to the present invention. In the drawings.

DESCRIPTION OF THE PREFERRED EMBODIMENTS

Figure 1:
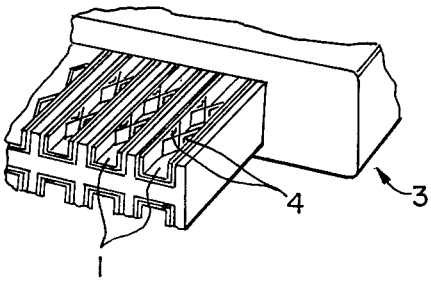
FIG. 1 is a perspective view of a terminal retaining body.
Figure 2:
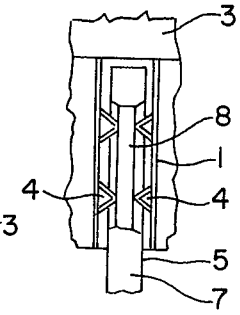
FIG. 2 is a plan view of a wire inserted in a non-deforming wire piercing terminal.

Referring to FIGS. 1 and 2, a plurality of non-deforming wire piercing terminals 1 are shown disposed in a terminal retaining body 3. Each of the terminals 1 include a plurality of projections 4 extending from the sidewalls.

Referring specifically to FIG. 2, when a wire 5 is inserted in a terminal 1, the projections 4 penetrate the wire insulation 7 and make electrical contact with the conductor 8.

Figure 3:
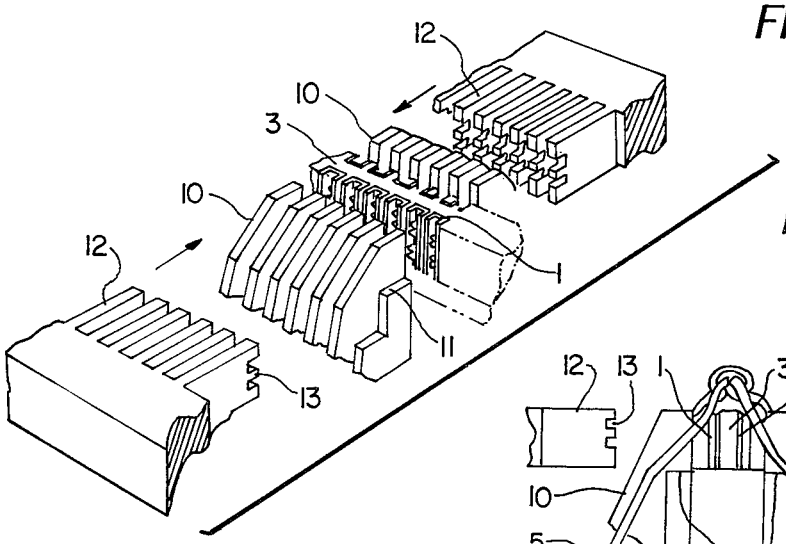
FIG. 3 is a perspective view of a portion of the wire insertion tool in position around a terminal retaining body prior to insertion of the wires.

FIG. 3 shows a terminal retaining body 3 in place between two sets of parallel guiding plates 10. Between each of the plates 10 is a cutting member 11 disposed to cooperate with the insertion tabs 12 to cut the wires. Each of the insertion tabs 12 include notches 13 for receiving the projections 4 of the terminals.

Figure 4:
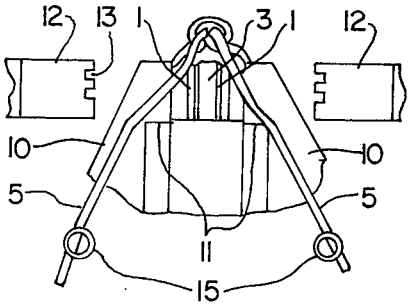
FIG. 4 is an end elevational view of portions of the wire insertion tool prior to inserting wires in a terminal retaining body.

As shown in FIG. 4, the wires 5 are inserted between each of the guiding plates 10 and extend beyond the cutting members 11. The end of each wire is secured in a wire holding spring 15.

Figure 5:
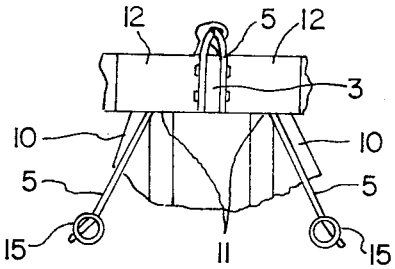
FIG. 5 is an end elevational view similar to FIG. 4 after the wires have been inserted in the terminals of the terminal retaining body.

After the insertion tabs 12 have been moved toward each other, as shown in FIG. 5, the wires 5 are severed by the cutting members 11 and insertion tabs 12. If the insertion tabs 12 are brought close enough together, the wires 5 are fully inserted in the terminals of the terminal retaining body 3.

Figure 6:
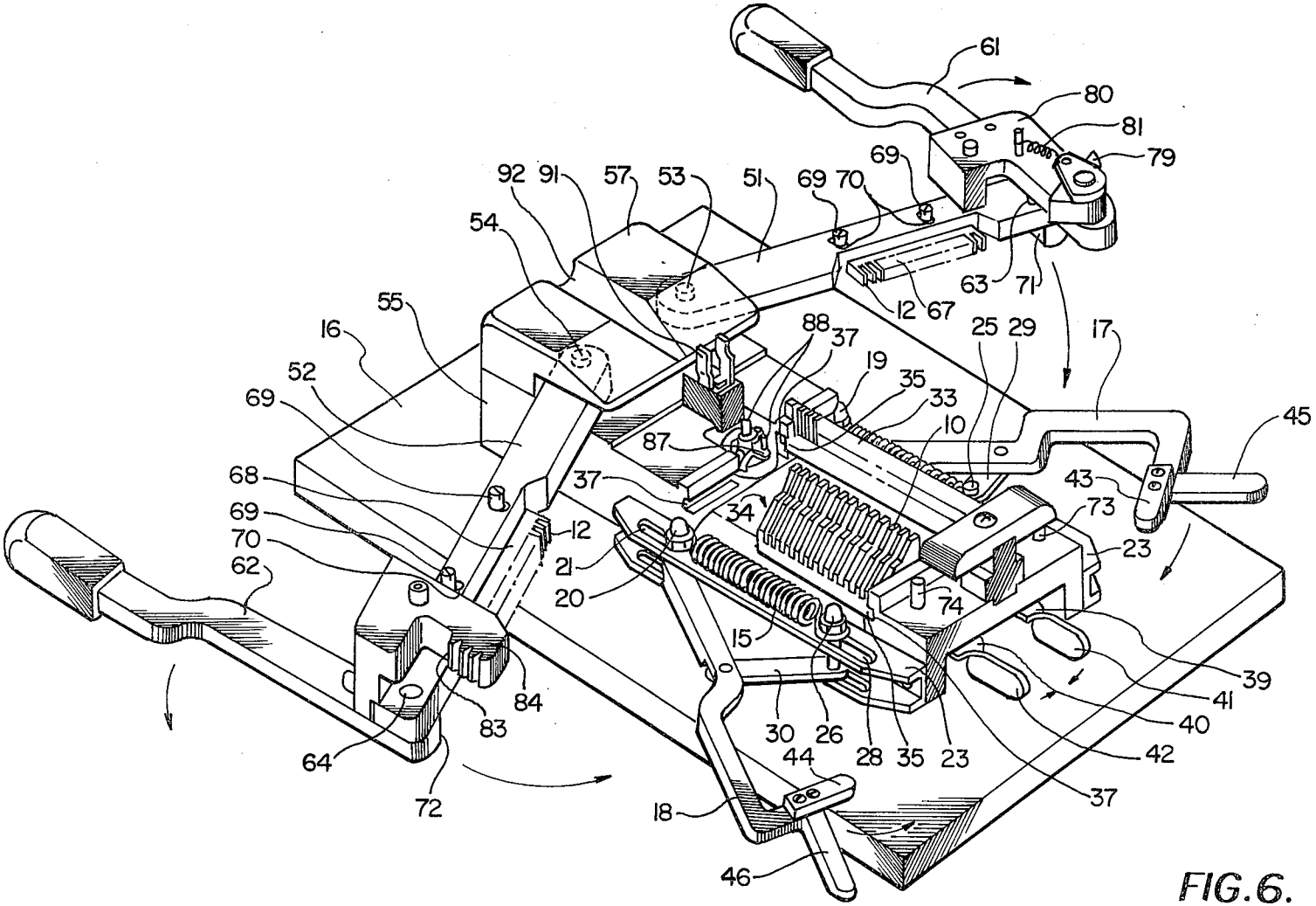
FIG. 6 is a partial cutaway perspective view of a preferred embodiment of the wire insertion tool.

FIG. 6 shows a preferred embodiment of the wire insertion tool according to the present invention. All of the elements of the tool are mounted on a base 16 which may be secured to a working surface by any known means, including suction cup feet or a non-skid backing.

Releasing handles 17 and 18 are pivotally mounted at one end thereof by means of bolts 19 and 20 which extend through slots 21 in mounting channels 23. Bolts 19 and 20 are connected to a first end of the two wire holding springs 15. The other ends of the springs are connected to bolts 25 and 26 which are slidable in slots 28 of mounting channels 23. The bolts 25 and 26 are coupled to releasing handles 17 and 18 through link members 29 and 30, respectively, such that movement of handles 17 and 18 towards each other causes the elongation of both of the springs 15.

Two sets 33 and 34 of substantially parallel guiding plates 10 are disposed between the two wire holding springs 15 and are slidably mounted by means of tabs 35 in channels 37, such that the two sets 33, 34 are slidable towards each other for holding a terminal retaining body therebetween. The plates 10 of the sets 33 and 34 are disposed such that the spaces between the plates would align with the terminals in a terminal retaining body placed between the two sets. The plates 10 extend perpendicular to the two faces of the terminal retaining body contacted by the sets 33 and 34.

Levers 39 and 40 are coupled to sets 33 and 34, respectively, such that when contact ends 41 and 42 of levers 39 and 40, respectively, are brought together, the two sets 33 and 34 of plate 10 are moved away from each other. Extensions 43 and 44 of releasing handles 17 and 18, respectively, engage contact ends 41 and 42, respectively, whereby the levers 39 and 40 are moved towards each other when the gripping sections 45 and 46 of the handles 17 and 18 are moved towards each other. Therefore, when the gripping sections 45 and 46 are moved towards each other (in the direction of the arrows), the springs 15 are extended and the levers 39 and 40 are moved towards each other (in the direction of the arrows) effecting movement of the two sets 33 and 34 of guiding plates away from each other. In this manner, the severed ends of the wires held by the springs 15 are released, and the terminal retaining body supported between the sets 33 and 34 of the guiding plates 10 are released.

Insertion arms 51 and 52 are pivotally mounted by means of pins 53 and 54, respectively, between blocks 55 and 57. Insertion handles 61 and 62 are pivotally mounted to the free end of insertion arms 51 and 52, respectively by means of pins 63 and 64. Each of the insertion arms 51, 52 may include a set 67, 68 of insertion tabs 12 adjustably secured by screws 69 through slots 70 (see FIG. 10). The insertion tabs 12 of the sets 67 and 68 are disposed such that when the arms 51 and 52 are rotated towards each other (in the direction of the arrows) the individual insertion tabs 12 will enter the spaces between the guide plates 10 of the sets 33 and 34.

Figure 11:
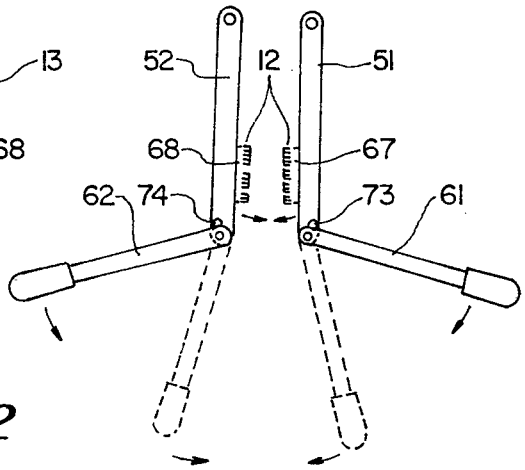
FIG. 11 is a plan view of the insertion handles showing the direction of movement required to effectuate insertion of the wires.

As best shown in FIG. 11, leverage faces 71 and 72 of insertion handles 61 and 62, respectively, engage fulcrums 73 and 74 when arms 51 and 52 are pivoted towards each other. As insertion handles 61 and 62 are pivoted in the direction of the arrows, the leverage surfaces 71 and 72 slide around the surface of fulcrum pins 73 and 74, respectively, thereby providing greatly increased leverage for the further movement of insertion arms 51 and 52 towards each other to effect the insertion of the wires in the terminals.

Figure 12:
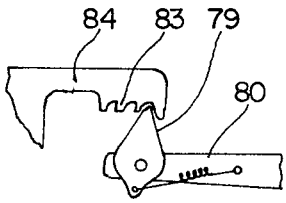
FIG. 12 is a plan view of the ratchet mechanism is a position corresponding to partial insertion of the wires in the terminals.
Figure 13:
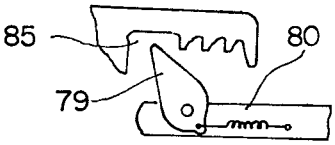
FIG. 13 is a plan view of the ratchet mechanism in a position corresponding to complete insertion of the wires in the terminals.

Referring to FIGS. 12 and 13, ratchet pawl 79 is pivotally mounted to suporting plate 80 which in turn is connected to insertion arm 51. The spring 81 biases the ratchet pawl 79 such that the pawl engages teeth 83 of ratchet plate 84 of arm 52, arms 51 and 52 are rotated towards each other. As arms 51 and 52 are brought within a predetermined distance of each other, the pawl enters recess 85 and disengages from teeth 83.

Alignment member 87 is positioned adjacent sets 33 and 34 of guiding plates 10 (see FIG. 6) and includes a plurality of alignment pins 88 of various sizes for insertion into the mounting holes of a terminal retaining body to properly align its terminals with respect to the spaces between the guiding plates 10.

Clamp 91 and channel 92 are provided to hold the wires out of the way of the moving parts of the tool.

Figure 7:
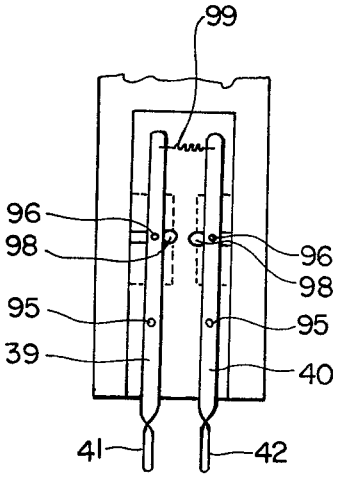
FIG. 7 is a plan view of the underside of a portion of the embodiment of FIG. 6 showing the details of the terminal retaining body releasing mechanism.

FIG. 7 shows the details of the levers 39 and 40 as seen from below the tool. The levers are pivoted on pins 95 and are coupled to sets 33 and 34 of guiding plates 10 through pins 96 at a point on the opposite side of pins 95 from contact ends 41 and 42. The pins 96 are free to move sideways in slots 98. Spring 99 biases the levers such that the two sets 33 are pulled towards each other.

Figure 8:
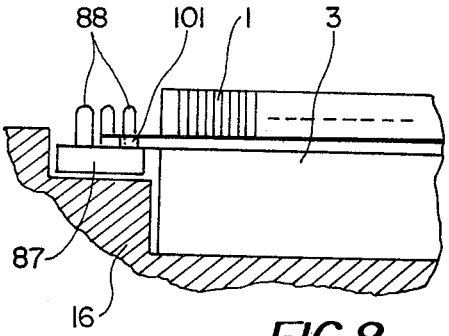
FIG. 8 is a side elevational view of a portion of the wire insertion tool showing the terminal retaining body alignment member.

As shown in FIG. 8, the alignment member 87 is rotatable to selectively place one of the variously sized alignment pins 88 into position for insertion through mounting hole 101 of terminal retaining body 3.

Figure 9:
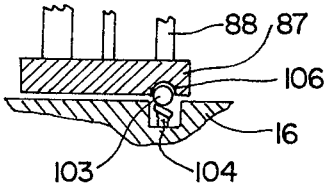
FIG. 9 is a cross-sectional view of the terminal retaining body alignment member.

FIG. 9 shows the ball 103 biased by the spring 104 into recess 106 of alignment member 87 for latching the alignment member in a preselected position.

The variously sized pins 88 are necessary since terminal retaining bodies of various sizes have variously sized mounting holes. By selecting the alignment pin which best fits the size of the mounting hole, proper alignment and steady support of the terminal retaining body is assured.

Figure 10:
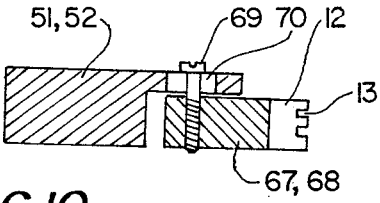
FIG. 10 is a cross-sectional view of one of the insertion handles showing the connection between the insertion tabs and the insertion handle.

Referring now to FIG. 10, insertion members 67 and 68 are slidably mounted on insertion arms 51 and 52 by screws 69 extending through slots 70, so that the spacing between insertion tabs 12 of insertion members 67 and insertion tabs 12 of insertion member 68 may be adjusted for use with terminal retaining bodies of various sizes.

In order to insert a plurality of wires in the terminals of a terminal retaining body, the gripping ends 45 and 46 of handles 17 and 18 are brought together, thereby extending the springs 15 and moving the sets 33 and 34 of guiding plates 10 away from each other. This makes it easy to insert a terminal retaining body between the sets 33 and 34. Each of the wires is then brought through the channel 92 and clamp 91 and between the correct pair of guiding plates 10 and a convenient pair of coils of the spring 15. When the gripping sections 45 and 46 are released, the terminal retaining body is securely supported between the guiding plates 10 and the end of the wires are securely held by the springs 15. The arms 51 and 52 are then rotated towards each other such that the insertion tabs 12 enter the spaces between the guiding plates 10. As the handles 61 and 62 are rotated against the fulcrum pins 73 and 74, the insertion tabs 12 are pushed further in towards the terminal retaining body and the wires are cut between the insertion tabs 12 and the cutting members 11. As the handles 61 and 62 are brought further together, the wires are inserted into the terminals 1. When the wires are completely inserted, ratchet pawl 79 releases from the last of the teeth 83 and enters recess 85, allowing the arms 51 and 52 to be moved away from each other. Gripping sections 45 and 46 of handles 17 and 18 are then brought towards each other again, extending the springs 15 to release the severed ends of the wires and moving the sets 33 and 34 of guiding plates 10 apart to release terminal retaining body 3.

As is evident from the above description, the wire insertion tool of the present invention is extremely simple to use and allows for very rapid wiring of multiconductor connectors, terminal blocks, and the like. The tool is adjustable for use with terminal retaining bodies of various sizes and assures alignment of the wires with the correct terminals. The ratchet mechanism of the above described embodiment assures that the wires are completely inserted in the terminals before the terminal retaining body is removed from the tool.

In the event that terminal retaining bodies having terminals along only one side are to be used in the device, the insertion member 67 or 68 may be removed from one of the insertion arms or a differently shaped arm may be provided which merely pushes against the outer edges of the guide plates 10 on the side of the terminal retaining body which does not contain any terminals.

From the foregoing, it can be readily realized that this invention can assume various embodiments. Thus, it is to be understood that the invention is not limited to the specific embodiments described herein, but is to be limited only by the appended claims.

We claim:

1. A wire insertion tool for inserting a plurality of wires in respective non-deforming insulation-piercing terminals retained in a terminal retaining body, said tool comprising:

a base;

terminal retaining body support means connected to said base for releasably supporting a terminal retaining body in a fixed position on said base;

wire holding means connected to said base for releasably holding a plurality of wires adjacent a terminal retaining body supported by said support means;

first and second releasing handles cooperating to release the terminal retaining body from said support means and the plurality of wires from said holding means;

wire guiding means for guiding each of the plurality of wires toward one of a plurality of terminals in the terminal retaining body;

first and second insertion handles, each of said handles having a first end pivotally connected to said base;

a plurality of wire insertion means for engaging respective ones of the plurality of wires, said wire insertion means being mounted on at least one of said insertion handles at a point remote from said first end, such that relative movement of said inserton handles in a first direction effects a corresponding movement of said plurality of insertion means and insertion of each of the wires in a respective terminal;

means for prohibiting movement of said insertion handles in a direction counter to said first direction during engagement of said insertion means with said wires until said wires are completely inserted within said terminals;

cutting means adjacent said guiding means and cooperating with said insertion means for cutting each of the wires at a predetermined point; and wherein said first and second releasing handles are mounted such that relative movement of said releasing handles in a first direction effects the substantially simultaneous release of said terminal retaining body from said support means and of the plurality of wires from said holding means.

2. The tool as claimed in claim 1, wherein said means for prohibiting movement comprises ratchet means connected to said insertion handles, said ratchet means including limiting means for prohibiting movement of said insertion handles in a direction counter to said first direction and disengaging means for disengaging said limiting means when said insertion handles are brought within a predetermined distance of one another, said predetermined distance corresponding to complete insertion of the wires into the terminals.

3. The tool as claimed in claim 2, wherein said limiting means includes: a ratchet pawl mounted on said first insertion handle and a ratchet plate mounted on said second insertion handle and having a set of teeth engagable by said pawl.

4. The tool as claimed in claim 1 for use with essentially rectangular terminal retaining bodies having terminals disposed along two opposite sides thereof, wherein said guiding means comprises two sets of spaced essentially parallel plates, one of said sets being disposed adjacent each of the two terminal retaining sides of the terminal retaining body, such that the spaces between the plates are aligned with the terminals and the plates extend perpendicular to the terminal retaining sides of the terminal retaining body.

5. The tool as claimed in claim 4, wherein each of said insertion means comprises a tab extending from one of said insertion handles, each of said tabs being disposed to fit in between respective pairs of said plates.

6. The tool as claimed in claim 5, wherein said cutting means comprises a plurality of cutting members, each of said cutting members disposed in one of said spaces between said plates and having a cutting edge for cooperating with respective ones of said tabs for cutting the wires.

7. The tool as claimed in claim 1, including positioning means mounted on said base and cooperating with said support means to hold the terminal retaining body in a position such that said insertion means and the terminals are in alignment.

8. The tool as claimed in claim 7, wherein said positioning means includes means for positioning terminal retaining bodies of a plurality of different shapes.

9. An insertion tool for inserting a plurality of wires in respective insulation-piercing terminals retained in a terminal retaining body, said tool comprising:

a base;

terminal retaining body support means connected to said base for releasably supporting a terminal retaining body in a fixed position on said base;

wire holding means connected to said base for releasably holding a plurality of wires adjacent a terminal retaining body supported by said support means;

means including first and second releasing handles mounted such that relative movement thereof in a first direction effects the substantially simultaneous release of the terminal retaining body from said support means and of the plurality of wires from said holding means;

wire guiding means for guiding each of the plurality of wires toward one of a plurality of terminals in the terminal retaining body;

first and second insertion handles, each of said handles having a first end pivotally connected to said base;

a plurality of wire insertion means for engaging respective ones of the plurality of wires, said wire insertion means being mounted on at least one of said insertion handles at a point remote from said first end, such that relative movement of said insertion handles in a first direction effects a corresponding movement of said plurality of insertion means and insertion of each of the wires in a respective terminal; and cutting means adjacent said guiding means and cooperating with said insertion means for cutting each of the wires at a predetermined point.

10. An insertion tool for inserting a plurality of wires in respective non-deforming insulation-piercing terminals retained in a terminal retaining body, said tool comprising:

a base;

terminal retaining body support means connected to said base for releasably supporting a terminal retaining body in a fixed position on said base;

at least one coil spring connected to said base for releasably holding a plurality of wires adjacent a terminal retaining body supported by said support means;

first and second releasing handles cooperating to release the terminal retaining body from said support means and the plurality of wires from said at least one coil spring, said releasing handles including stretching means for lengthening said at least one coil spring;

wire guiding means for guiding each of the plurality of wires toward one of a plurality of terminals in the terminal retaining body, said at least one coil spring being disposed adjacent said wire guiding means;

first and second insertion handles, each of said handles having a first end pivotally connected to said base;

a plurality of wire insertion means for engaging respective ones of the plurality of wires, said wire insertion means being mounted on at least one of said insertion handles at a point remote from said first end, such that relative movement of said insertion handles in a first direction effects a corresponding movement of said plurality of insertion means and insertion of each of the wires in a respective terminal; and cutting means adjacent said guiding means and cooperating with said insertion means for cutting each of the wires at a predetermined point.

11. A wire insertion tool for inserting a plurality of wires in respective non-deforming insulation-piercing terminals retained in a terminal retaining body, said tool comprising:

a base;

terminal retaining body support means connected to said base for releasably supporting a terminal retaining body in a fixed position on said base;

wire holding means including at least one coil spring connected to said base for releasably holding a plurality of wires adjacent a terminal retaining body supported by said support means;

first and second releasing handles cooperating to release the terminal retaining body from said support means and including stretching means for lengthening said at least one coil spring to release the plurality of wires from said holding means;

wire guiding means for guiding each of the plurality of wires toward one of a plurality of terminals in the terminal retaining body;

first and second insertion handles, each of said handles having a first end pivotally connected to said base;

a plurality of wire insertion means for engaging respective ones of the plurality of wires, said wire insertion means being mounted on at least one of said insertion handles at a point remote from said first end, such that relative movement of said insertion handles in a first direction effects a corresponding movement of said plurality of insertion means and insertion of each of the wires in a respective terminal;

means for prohibiting movement of said insertion handles in a direction counter to said first direction during engagement of said insertion means with said wires until said wires are completely inserted within said terminals; and cutting means adjacent said guiding means and cooperating with said insertion means for cutting each of the wires at a predetermined point.

12. An insertion tool for inserting a plurality of wires in respective insulation-piercing terminals retained in a terminal retaining body, said tool comprising:

a base;

terminal retaining body support means connected to said base for releasably supporting a terminal retaining body in a fixed position on said base;

wire holding means connected to said base for releasably holding a plurality of wires adjacent a terminal retaining body supported by said support means;

insertion means for engaging respective ones of the plurality of wires and insertion of each of the wires in a respective terminal; and means including first and second releasing handles mounted such that relative movement thereof in a first direction effects the substantially simultaneous release of the terminal retaining body from said support means and of the plurality of wires from said holding means.

* * * * *